US006626223B2

(12) United States Patent
Parker

(10) Patent No.: US 6,626,223 B2
(45) Date of Patent: Sep. 30, 2003

(54) PRESSURE SEALER FOR NESTED DOCUMENTS

(75) Inventor: Rebecca L. Parker, Grand Island, NY (US)

(73) Assignee: Moore North America, Inc., Grand Island, NY (US)

( * ) Notice: Subject to any disclaimer, the term of this patent is extended or adjusted under 35 U.S.C. 154(b) by 77 days.

(21) Appl. No.: 09/824,201

(22) Filed: Apr. 3, 2001

(65) Prior Publication Data

US 2002/0139488 A1 Oct. 3, 2002

(51) Int. Cl.[7] ..... B32B 31/04; B32B 31/20

(52) U.S. Cl. ..... 156/553; 156/555; 156/582; 156/581

(58) Field of Search ..... 156/582, 581, 156/555, 553, 441.5, 580, 583.91, 442.2, 559, 563, 290; 100/158 C, 160, 172, 176

(56) References Cited

U.S. PATENT DOCUMENTS

| | | | | |
|---|---|---|---|---|
| 4,030,960 A | | 6/1977 | Pratt | |
| 4,818,332 A | * | 4/1989 | Schultz et al. | 156/499 |
| 4,945,374 A | | 7/1990 | Yamamoto et al. | |
| 5,098,499 A | | 3/1992 | Bergamo | |
| 5,102,491 A | | 4/1992 | Correa | |
| 5,183,527 A | | 2/1993 | Parker | |
| 5,378,303 A | | 1/1995 | Traise | |
| 5,656,118 A | | 8/1997 | Traise | |
| 5,698,068 A | * | 12/1997 | Ichikawa et al. | 156/581 |
| 5,772,841 A | | 6/1998 | Lindsay | |
| 5,865,925 A | | 2/1999 | Lindsay | |
| 5,968,308 A | | 10/1999 | Lindsay | |
| 6,149,752 A | * | 11/2000 | Matthews et al. | 156/227 |
| 6,153,048 A | * | 11/2000 | Abramson et al. | 100/176 |

* cited by examiner

*Primary Examiner*—Richard Crispino
*Assistant Examiner*—George R. Koch, III
(74) *Attorney, Agent, or Firm*—Nixon & Vanderhye PC

(57) ABSTRACT

A pressure sealer machine is provided for the production of pressure sealed documents, and more specifically nested documents, that uses a number of roller cassettes disposed in side-by-side relation, in parallel to at least one drive roller, for handling forms with inserts. In the preferred embodiment, each cassette is a dual roller cassette to include infeed and outfeed rollers. The cassettes are sized relative to the wheels so that there is a lateral gap between adjacent seal wheels, so that the cassettes produce a seal pattern composed of a series of seal strips having a uniform gap therebetween. Each cassette is spring loaded at its top side and pressure is uniformly applied to the system using a pressure plate to compress all cassette springs simultaneously.

20 Claims, 6 Drawing Sheets

PRESSURE SEALER FOR NESTED DOCUMENTS

BACKGROUND AND SUMMARY OF THE INVENTION

Because of numerous operational advantages, equipment for pressure sealing business forms having pressure activated cohesive patterns thereon have become increasingly popular. Two commercial systems that effect pressure sealing of business forms are the Moore 4800 equipment, sold by Moore Business Forms, Inc. ("Moore"), and the Moore-Toppan 870, sold by Toppan Moore of Japan.

The Moore-Toppan system uses two full width roll pairs to successively engage an advancing business form over the full face of the form. Such equipment is very effective for two ply business forms having pressure sensitive cohesive patterns disposed thereon, such as the pressure sensitive cohesive shown in U.S. Pat. No. 4,918,128, and such as sold by Toppan-Moore under the trade designation "TM 124". While such a system is very successful, it is unsuitable for business forms with inserts (and other surface interruptions such as labels, windows, etc.) as the form may jam and/or mis-feed between the full width roller pairs, and a full seal may not be effected. The Moore 4800 system is conventionally used for business forms with inserts (and other surface interruptions such as labels, windows, etc.). The Moore 4800 design is based on perimeter sealing only, and uses two successive edge sealing mechanisms with a turn mechanism between the two sealer modules. While this machine is very effective, it requires more floor space than is desired, and requires close alignment with the folder or sheeter to which it is attached.

According to the present invention, a machine is provided that, in a simple, low cost manner, allows one to have the product flexibility of the Moore 4800, that is to handle media with inserts, windows, unequal folds, labels and other surface manifestations, without jamming or crushing of the components of the forms. The invention also allows these desirable end results to be accomplished without requiring the comparatively high floor space area of the Moore 4800.

According to one aspect of the invention, an apparatus for sealing pressure sensitive cohesive patterns on business forms and that can handle forms with inserts, in a single pass, comprises the following components: a main frame; at least one drive roller mounted to the main frame for rotation about a substantially stationary axis, each drive roller having an axial length of at least about five inches, a mechanism for rotating the at least one drive roller about the axis thereof; and an idler roller assembly. The idler roller assembly includes a plurality of idler roller cassettes each of which has at least one roller mounted for rotation about an axis that is substantially parallel to the rotary axis of the drive roller, a plurality of spring components, each for applying spring pressure to a respective idler roller cassette, and a pressure plate for engaging the plurality of spring components. The idler assembly is mounted so that a roller from each idler cassette cooperates with the drive roller so that business forms with inserts, labels, windows or other surface interruptions are fed therebetween without damage to the business forms.

A conveyor may be provided for conveying business forms into operative association with the at least one drive roller and/or an output conveyor may be provided for conveying business forms out of operative association with the drive and idler rollers.

The invention is also embodied in an apparatus that comprises first and second drive rollers mounted for rotation about parallel rotary axes and a main frame mounting a plurality of idler roller cassettes in operative association with the drive rollers to apply a compressive pressure to business forms passing between them. More specifically, each idler roller cassette is comprised of at least one roller mounted for rotation about a first idler axis, parallel to the drive axes of the drive rollers, the idler roller cassettes being provided at spaced locations along the first idler axis. In a preferred embodiment, each cassette is comprised of a pair of idler rollers or a roller couple, each idler roller being mounted for rotation about a respective idler axis that is parallel to the drive axis of a respective one of the first and second drive rollers. A spring is provided for applying spring pressure to each idler roller cassette and a plate is provided for engaging the springs, thereby to apply a uniform spring pressure to each idler cassette along the length of the idler axis. Each idler cassette is disposed between first and second cross brace shafts engaging opposite ends of the cassette main body to prevent substantial movement in a first direction parallel to form feed and perpendicular to the idler axis but to allow movement in a second direction perpendicular to form feed and perpendicular to the idler axis. The spring pressure plate is held in position so that movement of a cassette in the second direction is against the bias of the spring associated therewith. In the illustrated embodiment, the spring pressure plate is fixedly connected to the main frame as are the cross brace shafts.

BRIEF DESCRIPTION OF THE DRAWINGS

These, as well as other objects and advantages of this invention, will be more completely understood and appreciated by careful study of the following more detailed description of the presently preferred exemplary embodiments of the invention taken in conjunction with the accompanying drawings, in which.

DETAILED DESCRIPTION OF THE INVENTION

Figure 1:
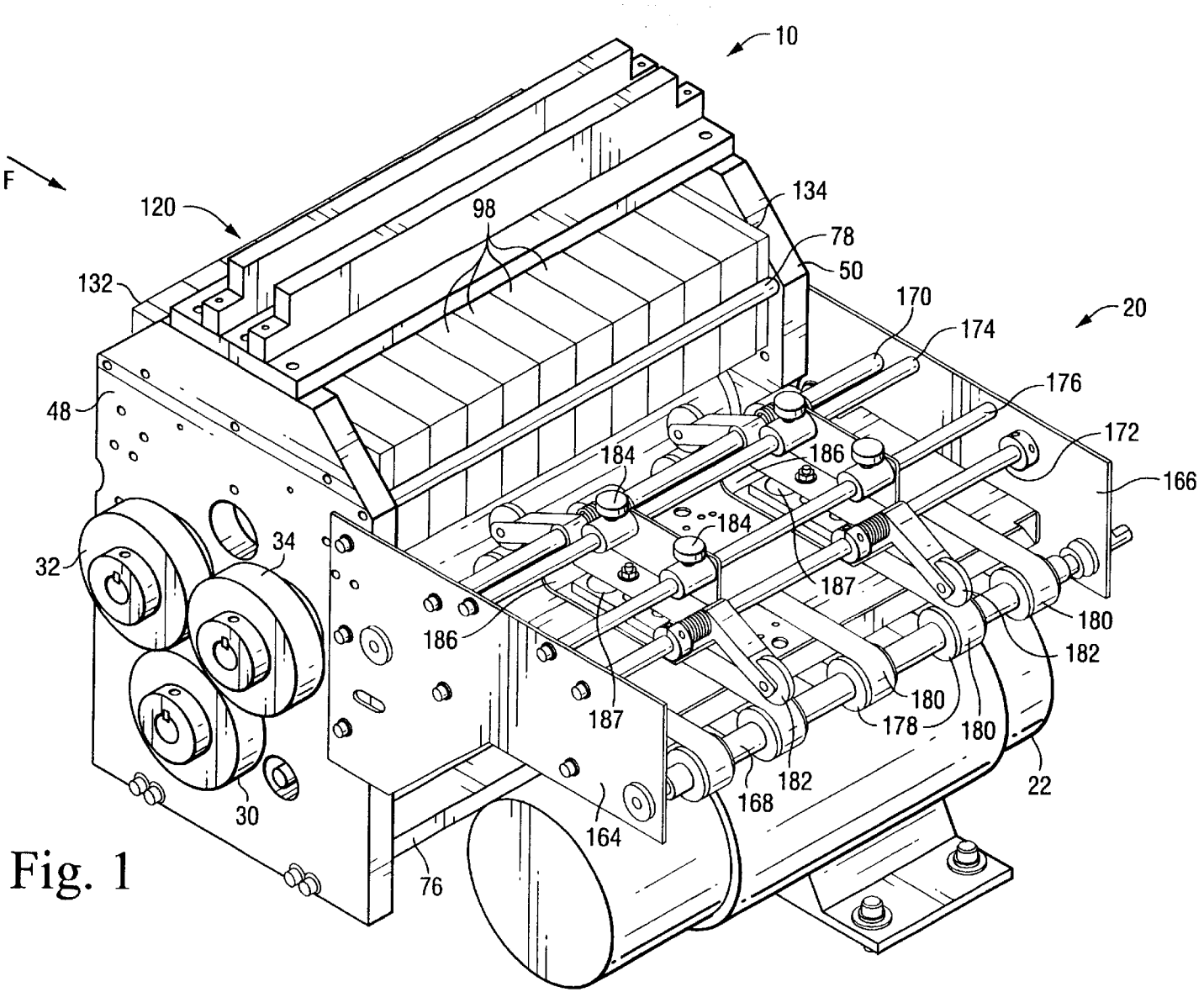
FIG. 1 is a perspective view of an exemplary pressure sealer apparatus according to the invention.

An exemplary apparatus for sealing pressure sensitive cohesive patterns on forms according to the present invention is shown generally by reference numeral 10. The illustrated apparatus includes a housing defined by a main frame 12, typically made from metal, that rotatably supports at least one and preferably first and second drive rollers 14, 16 that are disposed in opposed parallel relation to an idler roller assembly 18 that is designed to be used with business forms and the like having inserts or other surface interruptions such as labels, windows, or uneven folds and to effect sealing thereof in a single pass.

The housing is adapted to receive forms to be acted upon that are fed in direction F, either manually or from an upstream adjacent conveyor. In an exemplary embodiment, as illustrated, an outgoing or outfeed conveyor assembly 20 is provided for conveying business forms that have been acted upon in the direction of arrow F. The outfeed conveyor may be of any conventional conveyor configuration and thus does not form a part of the invention per se.

As noted above, the pressure seal apparatus 10 comprises at least one and preferably first and second drive rollers 14, 16 that are mounted to the housing main frame 12 for rotation about substantially parallel first and second axes. The rollers are axially elongated, having an axial length of at least about 5 inches and more typically about 11 inches in order to accommodate conventional sizes of forms to be fed therethrough.

Figure 2:
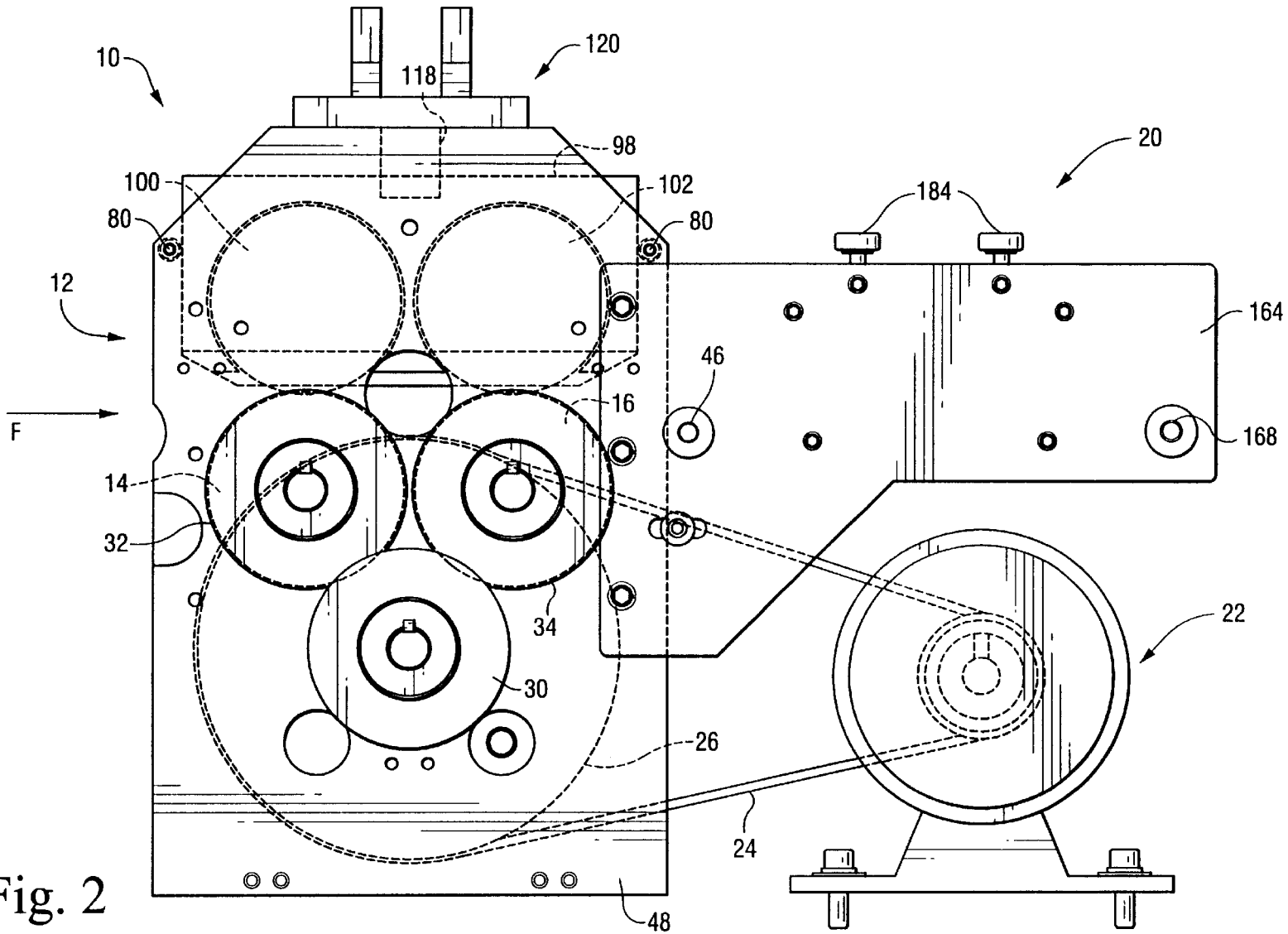
FIG. 2 is a side elevational view of the pressure sealer apparatus shown in FIG. 1.
Figure 3:
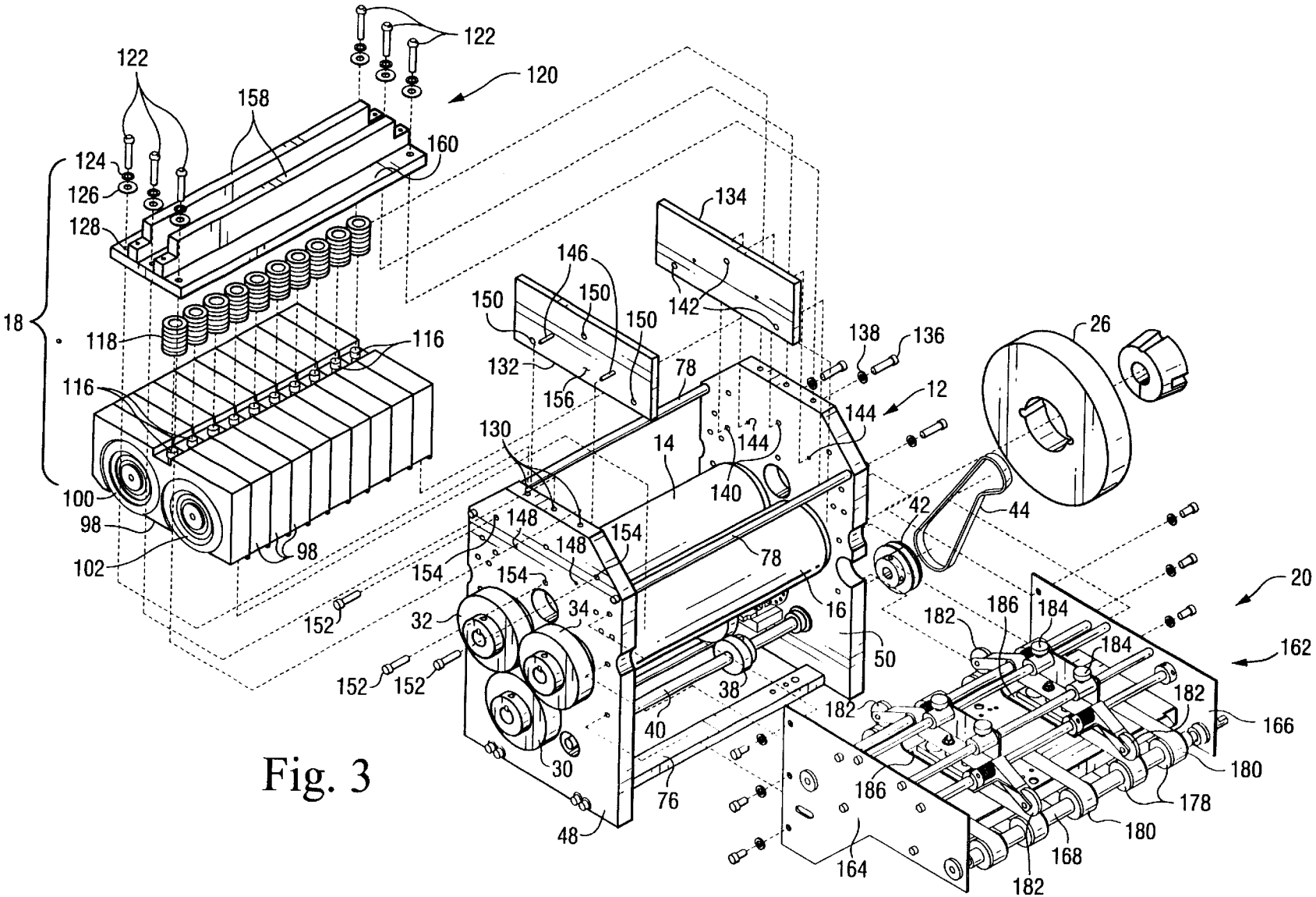
FIG. 3 is an exploded perspective view of the pressure sealer apparatus of FIG. 1 with the motor omitted for clarity.
Figure 4:
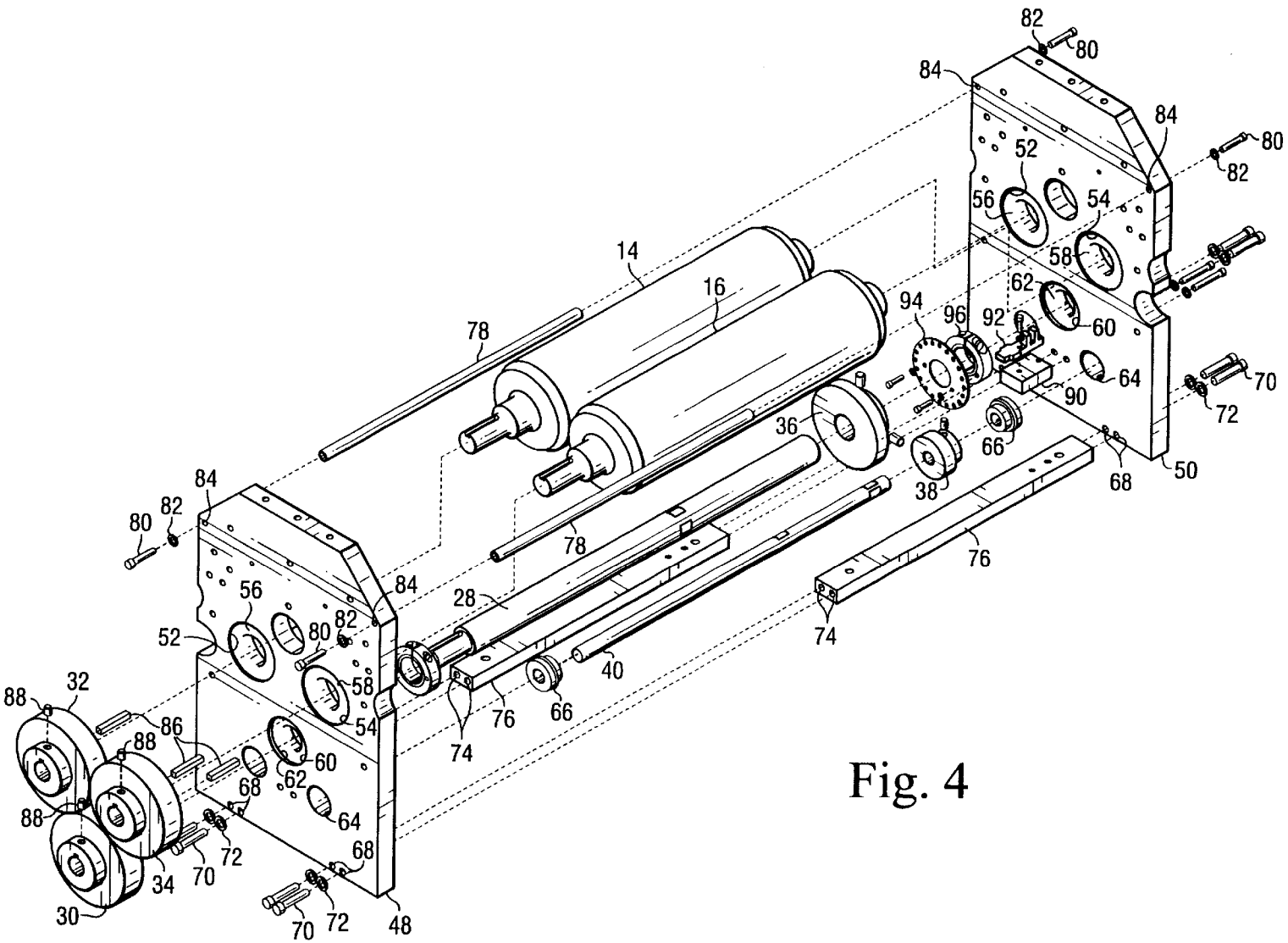
FIG. 4 is an exploded perspective view of the lower, drive rollers of the pressure seal apparatus of FIG. 1.

With reference to FIGS. 3 and 4, in the illustrated embodiment, the rollers are driven to rotate so that once a form is moved into contact therewith, it is driven by the rollers 14,16 in the direction of arrow F. The drive rollers in the illustrated embodiment are themselves driven by a motor 22 which is preferably fixedly mounted to a support structure (not shown) in prescribed relation to the housing frame as shown in FIGS. 1 and 2. The motor is connected by a drive belt 24 to a timing pulley 26 mounted on a main drive shaft 28.

A gear 30 is mounted to main drive shaft 28 to translate the rotation thereof to rotation of the drive rollers 14,16. Gear 30 engages gears 32 and 34 provided at one end of each of the first and second rollers 14,16. The drive gears 32,34 of the drive rollers are mounted to the axles of the respective roller by an axial slide fit. As illustrated in FIG. 4, a rotary lock between the gears 30,32,34 and the respective shaft/roller is provided with a machined key 86 or the like that is radially locked with a suitable set screw 88 or the like. If deemed necessary or desirable, gears can be provided at the other end or both ends of the rollers cooperating with corresponding gears on the drive shaft. It is to be understood that the above-described drive translation mechanism is merely exemplary, and the size and type of drive chain provided could be varied depending upon the desired roller speed and the motor used.

An assembly is also provided for transmitting rotation of the main drive shaft 28 to the outfeed conveyor 20. In the illustrated embodiment, a further drive gear 36 is provided on the main drive shaft 28 for engaging gear 38 mounted on a parallel conveyor drive shaft 40 that is coupled by a timing pulley 42 and timing belt 44 to a drive roller 46 of the outfeed conveyor 20 for coordinating the feed speed of the outfeed conveyor to that of the drive rollers 14,16. Additional components may be mounted to the main drive shaft to sense the rotational position and/or rotary speed of the main drive shaft. More specifically, a sensor mounting block 90 is secured to one of the side plates 50 for supporting a suitable sensor 92 associated with an encoder disk 94 and encoder disk collar 96 for securing the same with respect to the main drive shaft 28. The encoder disk and sensor of the presently preferred embodiment are highly desirable for monitoring and controlling operation of the pressure sealer but are not critical components thereof.

In the illustrated embodiment, the housing main frame 12 is comprised of first and second side plates 48,50 each of which includes a plurality of openings for receipt of various components of the drive rollers, drive shaft and idler roller assembly as described in greater detail below. For example, holes 52,54, respectively receive bearings 56,58 for respectively supporting the first and second drive rollers 14,16, openings 60 have bearings 62 therein for rotatably supporting the main drive shaft 28, and openings 64 receive the bearings 66 for rotatably supporting the outfeed conveyor shaft 40. Furthermore, openings 68 are provided to receive bolts 70 fed through respective lock washers 72 for being received in tapped holes 74 in the ends of mounting bars 76 for defining a bottom of the main frame 12 and for mounting the main frame 12 to the support assembly (not shown). The upper ends of the respective side plates 48,50 are interconnected and held in spaced apart relation by cross brace shafts 78 that are secured in position by bolts 80 fed through respective lock washers 82 aligned with holes 84. The mounting bars 76 and cross brace shafts 78 provide rigidity to the housing.

As noted above, in the illustrated embodiment, bearing structures 56,58 are interposed between the drive roller axles and side plates. As an alternative to such a structure, the rollers may be of the "dead shaft" construction such that the roller shafts are stationary, connected by bolts to the side plates, with internal bearings disposed between the roller component and the shaft.

The idler roller assembly 18 is made up of a plurality of individual idler roller components in the form of cassettes 98, each cassette having at least one and more preferably two rollers 100,102 spaced from each other in the direction of arrow F, and rotatable about respective parallel axes which are parallel to the axis of the at least one drive roller 14,16. Where first and second drive rollers are provided, the axes of the rollers of each cassette are aligned therewith so that the rollers of each cassette are each in opposed facing relation to a respective drive roller. A plurality of cassettes 98 are provided to effect the desired sealing and to accommodate a wide variety of different form dimensions in a direction perpendicular to direction F, as described in greater detail below.

Figure 5:
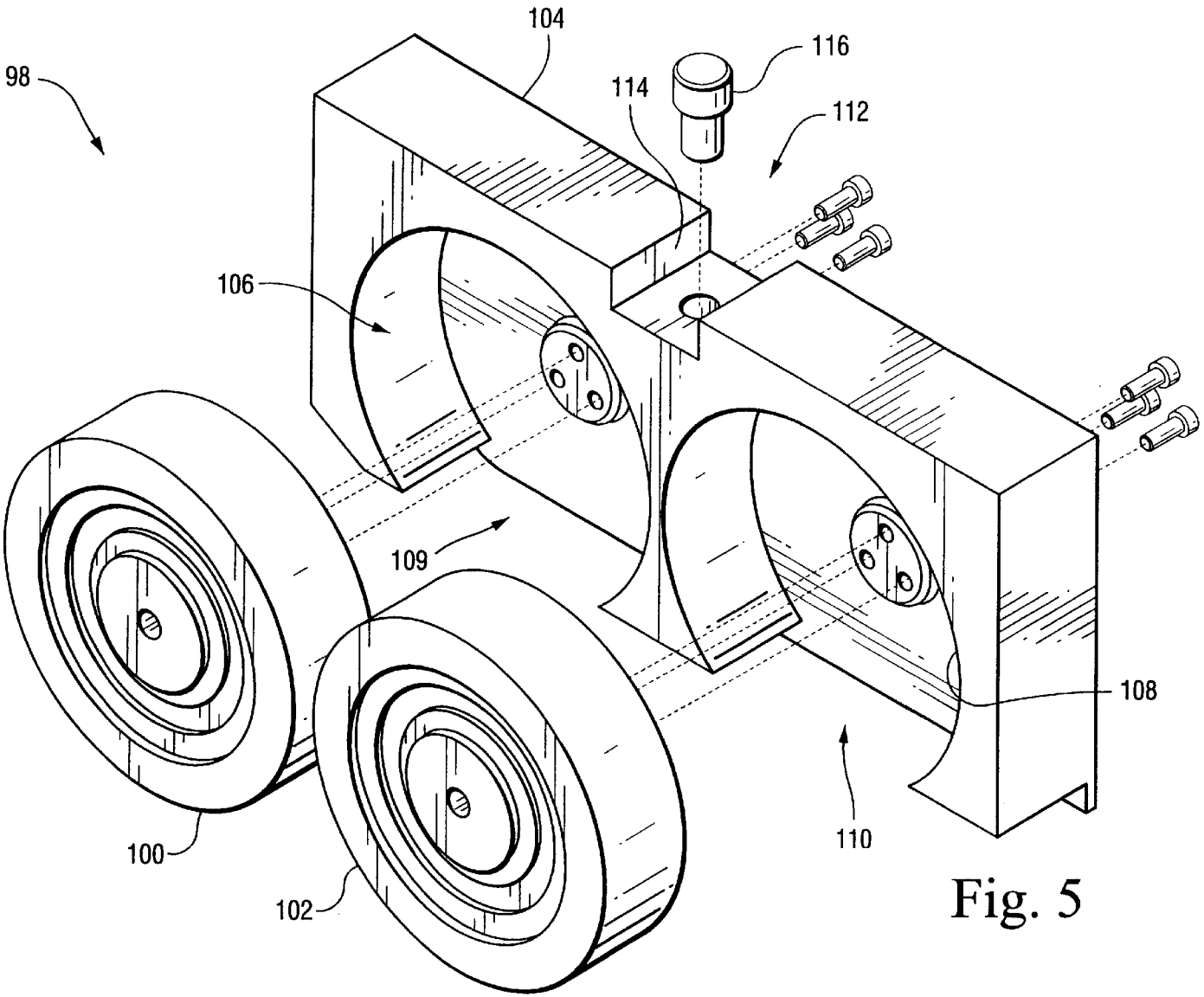
FIG. 5 is an exploded perspective view of an exemplary cassette according to the invention.
Figure 6:
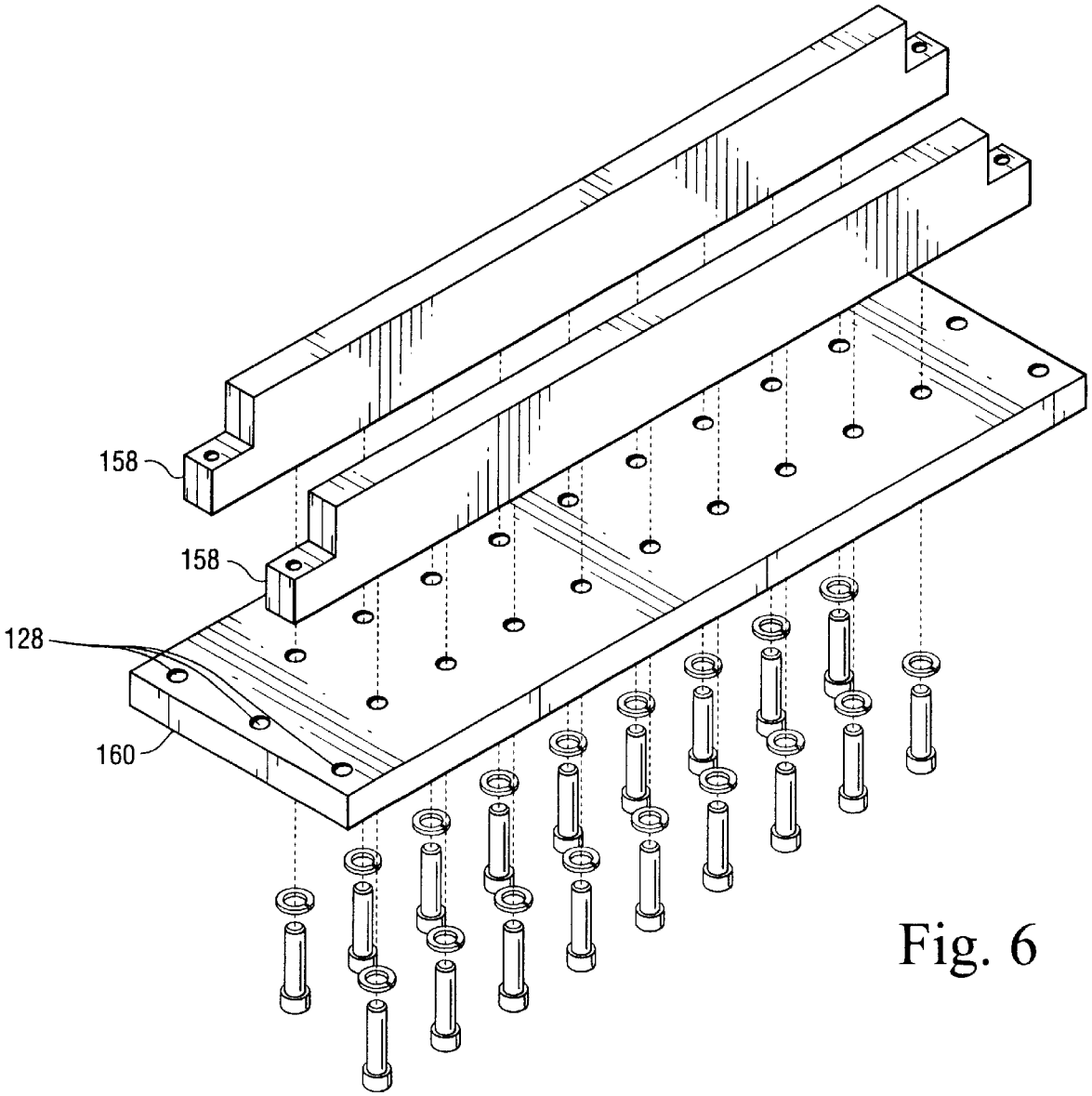
FIG. 6 is an exploded perspective view of a pressure plate assembly according to an embodiment of the invention.

With reference to FIG. 5, each cassette includes a main body 104 including a generally circular recess 106,108 to accommodate each roller 100,102. Each receptacle is configured to expose a portion of the roller defined therein for engaging and applying a sealing pressure to a form fed between the same and the drive roller facing thereto (FIG. 2). On the opposite side of the main body from the open ends 109,110 of the receptacles is a spring mount 112. In the illustrated embodiment, a cut out or recess 114 is defined in the top surface of the cassette main body 104 and a spring locator, which in the illustrated embodiment is defined by a bolt 116 or the like, is secured therein. A spring 118 is disposed in coaxial relation to the bolt 116 as shown in FIG. 3. As can be seen, the spring is disposed in surrounding relation to but is not fixed with respect to nor secured to the bolt, so that the bolt merely defines a location for the spring but does not tension the same or secure it to the cassette. The upper end of each spring is engaged with a spring pressure plate assembly 120 for urging the respective cassette 98 towards the drive roller(s) 14,16, as described in greater detail below.

As illustrated in FIG. 3, a plurality of roller cassettes 98 are disposed in side by side relation to define, in the illustrated embodiment, first and second aligned rows of idler rollers 100,102, each row or set of idler rollers 100,102 being disposed to rotate about a common axis that is disposed in parallel relation to the axis of the respective drive roller 14,16 therebelow. A coil spring 118 is disposed or located at the spring mount 112 of each of the cassettes, as noted above, for being commonly engaged for urging the cassettes 98 toward the drive rollers 14,16.

In accordance with the invention, an assembly is provided for keeping the cassettes lined up side to side. Indeed, some mechanism or apparatus is desirably provided for keeping the cassettes lined up side by side, else the cassettes will lean over and ride on hard edges. In the presently preferred embodiment, locator spacer plates are provided although other assemblies may be provided. The cassettes are lined up in position touching each other. At the end of the array of cassettes a locator spacer is preferably provided to hold the end cassettes in the proper position relative to the side frames. This establishes the side to side placement of the cassettes with relatively tight fit to prevent undesirable cocking that might occur.

The manner in which the cassettes are mounted with respect to the main frame side plates is also best seen in FIG. 3. In the illustrated embodiment, first and second locator plates 132,134 are provided, one (134) secured to one of the side plates 48,50 and the other adjustably disposed with respect to the other side plate so that the cassettes 98 can be sandwiched between the movable plate 132 and the fixed plate 134. In the illustrated embodiment, the left side plate 50 with respect to the direction of feed F has a locator plate 134 secured thereto by bolts 136 fed through respective split lock washers 138, through through-holes 140 defined in the side plate 50, and into receptacle tapped holes 142 defined through the locator plate 134. The locator plate 134 also includes first and second guide pins (not shown in FIG. 3) that are received in respective through holes 144 defined in side plate 50 to properly locate the locator plate 134 vertically with respect to the side plate 50 and to align the respective bolt holes 140,142. The other locator plate 132 which is mounted to the right side plate 48, with respect to the direction of feed F, also has guide pins 146 received in respective locator through-holes 148 defined in the side plate 48. However, no attachment bolts are received in the attachment holes 150 thereof. Instead, position screws 152 are fed through respective tapped holes 154 to engage the outer side face 156 of the locator plate 132 to selectively urge the locator plate 132 towards the left side locator plate 134. In an exemplary embodiment, the locator plates are formed from aluminum. In the alternative to a locator spacer as shown, precisely machined plastic spacers may be applied. An advantage of the illustrated locator plates is that they do not require precision machining and they allow the operator to compensate for variances in cassette width as necessary. As a further alternative to locator plates as illustrated, or a precision machined plastic spacer, a non precision spacer may be provided at each end of the cassette array with shims utilized on one end and/or the other to fill any required gap as may vary from machine to machine.

A further important feature of the invention is a component or components for keeping the cassette wheels 100,102 on top dead center on the respective lower rollers 14,16. In the presently preferred embodiment, the cross brace shafts 78 that rigidify the main frame 12 are disposed at the infeed and outfeed ends of the cassettes 98 to perform the position limiting function, but other position limiting structures could be employed without departing from the invention. More specifically, the infeed-to-outfeed position of the cassette is determined by the two cross brace shafts 78 that span the distance between the side frames 48, 50, one at the infeed end and one at the outfeed end of the apparatus. There is a little space between the shafts 78 and the cassettes 98, which allows the cassettes 98 to shift up and down as necessary when the forms pass beneath them in opposition to the spring loading thereof provided by the spring assembly, discussed in greater detail below.

Thus, once the locator plate 134 is secured to the left side wall 50 and the locator plate 132 is disposed so that the guide pins 146 are received through the respective locator holes 148, the cassettes 98 are disposed between the locator plates. As noted, the locator plate 132 is desirably disposed to the side plate 48 with guide pins 146 in the receptacles 148 therefor before the cassettes 98 are loaded, but is not displaced toward locator plate 134 until after all cassettes 98 have been disposed between the cross brace shafts 78. Then, the position screws 152 can be adjusted to axially secure the idler cassettes within the housing main frame, between the locator plates 132,134. It should be noted that the position screws 152 are displaced to position the cassettes upright between the locator plates, in face to face abutting relation but so as to allow vertical displacement with respect to the drive rollers. Therefore the position screws 152 and locator plates 132,134 are not for the purpose of immovably clamping the cassettes in the housing main frame.

Once the cassettes are in place and their respective coil springs 118 are disposed on the respective spring positioning screws 116, the pressure plate assembly is secured, e.g., to the top edge of the side frame to uniformly urge the cassettes towards the respective drive roller. More specifically, in the illustrated embodiment, the pressure plate 160 of the assembly 120 is secured to the side plates 48,50, by for example screws 122 that are fed through respective split lock washers 124, flat washers 126, and bores 128 defined therethrough and then threaded into respective tapped openings 130 in the top edge of the side plates 48,50. Thus, the pressure plate assembly 120 is disposed in fixed relation to the side plates 48,50 at a prescribed height above the fixed height drive rollers 14,16 so that the cassettes 98 can each individually be displaced upwardly and downwardly between the drive rollers and the pressure plate assembly 120, against the urging force of their respective coil springs 118. Meanwhile, the cross brace shafts 78 will preclude displacement of the respective cassettes in the direction F of form feed so that the cassettes are generally confined to vertical displacement.

As mentioned above, a pressure plate assembly 120 is disposed above the idler roller cassettes 98 to capture the same within the main frame 12 of the housing. The pressure plate assembly can take any form that will withstand the force applied by the springs. In the present embodiment, pressure plate braces 158 are provided to minimize the potential for distortion of the plate 160 of the assembly under the influence of the springs 118, particularly as cassettes 98 pass over inserts.

As is apparent from the foregoing, the side plates 48,50 and locater plates 132,134 laterally confine the idler roller cassettes 98 and the pressure plate assembly 120 and drive rollers 14,16 vertically confine the idler roller cassettes 98. The cassettes are also confined in feed direction F, by the cross brace shafts 78.

In the presently preferred embodiment, the lower drive rollers are a pair of lower solid rollers comprising infeed and outfeed rollers that are provided in combination with the set of upper cassettes. The cassettes of the illustrated embodiment were adapted in particular to process 8.5 inch wide forms and 11 inch wide forms with both sizes running centered. Thus, in the present preferred embodiment, there are 10 cassettes, each of which has two wheels, one designated as an infeed and the second as an outfeed wheel, each with a face width of 0.875 inches. The cassettes are placed on 1.125 inch centers so there is a 0.25 lateral gap between adjacent idler rollers. On an 8.5 inch wide product, this produces a seal pattern consisting of a 0.75 inch wide seal strip on each short edge and a total of 6 seal stripes, each 0.875 inches wide down the middle of the form. All seal stripes have gaps of 0.25 inches between them. This pattern is generally considered adequate for sealing commercially available returnable envelope constructions. An 11 inch wide product will simply have 10 equal seal stripes of 0.875 inch width each separated by a 0.25 inch wide gap. In a preferred embodiment, each cassette is spring loaded from above with enough force to produce about 300 pounds per lineal inch of pressure on each upper wheel.

A preferred number of cassettes, cassette width and spacing has been described above consistent with a presently preferred implementation of the invention. Different form specifications may require more or fewer cassettes or perhaps different wheel widths or spacings. For example, if 8½ inches were the maximum form width instead of 11 inches, fewer cassettes could be provided such as 8 cassettes instead of 10.

As to the lower roller size and spacing, the diameter and/or length of the lower, drive rollers would desirably change if the number of cassettes or sealing requirements is changed. For example, fewer cassettes would allow the use of smaller, that is shorter, drive rollers. If the seal does not have to be aggressive, for example, if the system is only required to seal forms that have been imaged on printers that do not employ silicone oils, the drive rollers can be smaller as well. If the shortest folded form were larger, currently it is an 8.5 inch by 11 inch Z fold which folds to 3.67 inches, the rollers could be further apart. Finally, if the maximum width of the forms were smaller, the lower rollers would not have to be as long.

In the illustrated embodiment, the outfeed conveyor 20 includes an outfeed conveyor frame 162 including first and second side plates 164,166 interconnected by belt roller shafts 46,168, idler roller shafts 170,172 and idler assembly adjustment shafts 174,176. The drive roller shafts each include a plurality of rollers 178 having respective belts 180 disposed about the same to define an outfeed conveying surface. As noted above, the conveyor drive shaft 40 is driven by the main drive shaft 28 to translate rotation of the main drive shaft to the upstream belt roller shaft 46 of the outfeed conveyor assembly 20. Idler rollers 182 are mounted in a spring loaded manner to idler roller shafts 170, 172 to define input and output nips of the outfeed conveyor surface. In the illustrated embodiment, a pair of ball racks 186 is provided between the input and output nips of the outfeed conveyor surface. Each ball rack 186 includes a plurality of balls 187 that are in contact with the belts 180. As a form is passed through the conveyor assembly 20, the balls 187 and belts 180 keep the form in position to minimize jams. Each ball rack 186 can be adjusted left-to-right with respect to the direction of feed F by loosening respective thumb screws 184, axially displacing the ball racks, and securing the thumb screw again. The ball racks 186 are mounted just above the belts 180 to ensure feed generally flush to the output conveyor belt surface, to minimize jamming and the like. It is to be appreciated that another outfeed conveyor assembly may be provided without departing from the invention. Indeed, as noted above, an outfeed conveyor is preferably provided but is not critical to the successful operation of the pressure sealer apparatus. In the event the outfeed conveyor is omitted, the outfeed conveyor drive shaft, associated bearings, gears, pulley and belt used to power the outfeed conveyor may be omitted. In the alternative an outfeed conveyor with an independent drive assembly may be provided.

In the use of the apparatus illustrated in FIGS. 1–3, to seal a business form having an insert, the form is transported by a conveyor (not shown) or manually fed in the direction F to the nip between the first set of idler rollers 100 and the opposed drive roller 14. In advance of form feed, the position of the cassettes 98 is adjusted so that the cassettes are mounted by the locator plates 132,134 to be at positions corresponding to desired portions of the form. Unused cassettes beyond the business form width can be removed from the machine, if desired. The form, with side strips thereof adjacent longitudinal edges of the form aligned with respective rollers 100,102 for securing the edges at the end of the idler roller assembly, is grasped and driven by the rollers 100,14 at the nip. All of the rollers of the cassettes between the edges of the business form come into contact with the leading edge of the business form and because of the spring pressure applied by their respective springs 118 and the pressure plate 120 assembly will effect the seal of the cohesive at the portions contacted thereby. Since the rollers will be spaced at least about 0.25 inches from each other along the length of the edge there will be regularly spaced discreet portions of the cohesive along the length of the edge where sealing does take place, but there are also spaces between the seal portions where there is no sealing even though cohesive may be present, because no roller has applied pressure thereto.

As the form continues to be driven in the direction F, the rollers of the cassettes engage the portions of the business form including any insert thereof. The presence of a varying thickness of the business form by virtue of an insert will cam the respective cassette upwardly. This upward displacement of individual cassettes is allowed because of individual spring loaded mounting of the cassettes such that they are not rigidly connected either to the cross brace shafts or to each other. Moreover, the central location of the coil spring permits a small rocking action to take place, limited by the cross brace shafts, allowing the insert to pass completely through the nip between the rolls without being crushed or without splaying of the form while effectively sealing those portions of the form where pressure seal cohesive is disposed in opposed facing relation. Since some cassettes will be directly aligned with cohesive strips along longitudinal edges of the form, the form will be sealed along the entire length thereof. The same intermittent sealing action at the trailing edge of the form occurs as takes place with respect to the leading edge of the form.

It is presently preferred to use two sets of rollers for the pressure seal unit, thereby hitting each form twice with pressure. If such a high sealing standard is not required, one may be able to provide a suitable seal with a single lower roller and one wheel per upper cassette. In this case, each pressure spring would be moved to be centered on the wheel in a cassette and the main drive shaft would be eliminated so that the motor drives the lower roller directly.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. Apparatus for sealing pressure sensitive cohesive patterns on business forms, comprising:

a main frame;

at least one drive roller mounted to the main frame for rotation about a substantially stationary axis, each drive roller having an axial length of at least about five inches;

a drive assembly for rotating the at least one drive roller about the axis thereof; and an idler roller assembly, said idler roller assembly including a plurality of idler roller cassettes, each of which has at least one idler roller mounted for rotation about an axis that is substantially parallel to the rotary axis of the drive roller, a plurality of spring components, each for applying spring pressure to a respective idler roller cassette, and a pressure plate for engaging the plurality of spring components to uniformly compress the same to urge said idler roller cassettes toward said at least one drive roller.

2. Apparatus as recited in claim 1, wherein said drive assembly includes a motor; stationary mounted adjacent said main frame.

3. Apparatus as recited in claim 1, wherein there are first and second drive rollers, and wherein said drive assembly comprises a gear connected to at least one end of each of said first and second rollers, a motor, and a drive chain interconnecting said motor and said gears of said drive rollers.

4. Apparatus as recited in claim 1, wherein each of said idler roller cassette comprises a main body defining a receptacle for each said idler roller thereof.

5. Apparatus as recited in claim 4, wherein a spring mount is defined in an upper surface of said main body at a central portion thereof, said spring mount including a recess and a spring locator; and wherein each said spring component comprises a coil spring mounted in a respective said recess with a first end thereof abutting said main body, an independent coil spring being provided for each cassette, said pressure plate engaging each said coil springs at a second end thereof, opposite said first end.

6. Apparatus as recited in claim 1, wherein said main frame further comprises first and second brace components disposed adjacent opposite longitudinal ends of each said cassette main body to prevent substantial movement thereof in a first direction perpendicular to said idler roller axis, but to allow movement thereof in a second direction perpendicular to said axis and perpendicular to said first direction; said pressure plate being substantially fixed with respect to said main frame, and said spring components being disposed between said pressure plate and said cassettes, so that movement of said cassettes in said second direction is against the bias of said spring components.

7. Apparatus as recited in claim 6, wherein said main frame comprises first and second side plates, said first and second brace components comprising first and second cross brace shafts disposed in parallel to said idler roller axis and extending between and interconnecting said first and second side plates.

8. Apparatus as recited in claim 7, wherein said pressure plate is secured to and extends between said first and second side plates.

9. Apparatus as recited in claim 1, wherein each of said idler rollers has an axial dimension of less than one inch.

10. Apparatus as recited in claim 1, wherein said idler roller assembly further comprises a mounting assembly for mounting said idler roller assembly to said main frame means so that a disposition of said cassettes along said axis of said drive roller is adjustable to dispose two of said plurality of cassettes along the edges of business forms in the direction of travel through said apparatus.

11. Apparatus as recited in claim 10, wherein said main frame comprises first and second interconnected side plates, and wherein said mounting assembly comprises first and second locator plates, one disposed between each said side plate and said plurality of cassettes, and wherein at least one of said locator plates is adjustably disposed with respect to the side plate adjacent thereto.

12. Apparatus as recited in claim 1, further comprising an outfeed conveyor for conveying business forms out of operative association with the at least one drive roller and idler rollers, said outfeed conveyor being operatively coupled to said drive assembly for being driven thereby.

13. Apparatus for sealing pressure sensitive cohesive patterns on business forms, comprising:

first and second drive rollers mounted for rotation about parallel rotary axes;

a drive assembly for rotating the first and second drive rollers about the axis thereof;

a main frame mounting a plurality of idler roller cassettes in operative association with the drive rollers to apply a compressive pressure to business forms passing between them, each idler roller cassette comprising a pair of idler rollers, each idler roller being mounted for rotation about a respective idler axis that is parallel to the drive axis of a respective one of the first and second drive rollers;

a plurality of spring components, each for applying spring pressure to a respective idler roller cassette; and a pressure plate for engaging the plurality of spring components to uniformly compress the same to urge said idler roller cassettes toward said first and second drive rollers.

14. Apparatus as recited in claim 1, wherein said drive assembly includes a motor mounted adjacent said main frame.

15. Apparatus as recited in claim 13, wherein said pressure plate and said spring components urge said idler roller cassettes so that said idler rollers cooperate with said first and second drive rollers to apply a compressive pressure to business forms passing between them of at least about 300 pounds per lineal inch.

16. Apparatus as recited in claim 13, wherein each of said idler roller cassette comprises a main body defining a receptacle for each said idler roller thereof, and wherein a spring mount is defined in an upper surface of said main body at a central portion thereof, said spring mount including a recess and a spring locator; and wherein each said spring component comprises a coil spring mounted in a respective said recess with a first end thereof abutting said main body, an independent coil spring being provided for each cassette, said pressure plate engaging each said coil springs at a second end thereof, opposite said first end.

17. Apparatus as recited in claim 13, wherein said main frame further comprises first and second brace components disposed adjacent opposite longitudinal ends of each said cassette main body to prevent substantial movement thereof in a first direction perpendicular to said idler roller axis, but to allow movement thereof in a second direction perpendicular to said axis and perpendicular to said first direction; said pressure plate being substantially fixed with respect to said main frame, and said spring components being disposed between said pressure plate and said cassettes, so that movement of said cassettes in said second direction is against the bias of said spring components.

18. Apparatus as recited in claim 17, wherein said main frame comprises first and second side plates, said first and second brace components comprising first and second cross brace shafts disposed in parallel to said idler roller axes and extending between and interconnecting said first and second side plates, and wherein said pressure plate is secured to and extends between said first and second side plates.

19. Apparatus as recited in claim 13, wherein each of said idler rollers has an axial dimension of less than one inch.

20. Apparatus as recited in claim 13, wherein said main frame comprises first and second interconnected side plates, and wherein said idler roller assembly further comprises a mounting assembly for mounting said idler roller assembly to said main frame means so that a disposition of said cassettes along said axis of said respective one of said first and second drive rollers is adjustable to dispose two of said plurality of cassettes along the edges of business forms in the direction of travel through said apparatus, said mounting assembly comprises first and second locator plates, one disposed between each said side plate and said plurality of cassettes, and wherein at least one of said locator plates is adjustably disposed with respect to the side plate adjacent thereto.

* * * * *